United States Patent [19]

Marino

[11] Patent Number: 4,991,733

[45] Date of Patent: Feb. 12, 1991

[54] CLOSURE AND CONTAINER HAVING PASS OVER INTER-ENGAGING RATCHET TEETH

[75] Inventor: Michael Marino, New Castle, Pa.

[73] Assignee: West Penn Plastic, Inc., New Castle, Pa.

[21] Appl. No.: 411,838

[22] Filed: Sep. 25, 1989

[51] Int. Cl.[5] ..... B65D 41/04; B65D 50/00

[52] U.S. Cl. ..... 215/330; 215/216

[58] Field of Search ..... 215/330, 329, 331, 337, 215/339, 216, 218

[56] References Cited

U.S. PATENT DOCUMENTS

| | | | |
|---|---|---|---|
| 1,304,098 | 5/1919 | Rivers | 215/331 |
| 4,091,949 | 5/1978 | Fowles et al. | 215/232 X |
| 4,270,664 | 6/1981 | Buono | 215/330 X |
| 4,662,530 | 5/1987 | Goncalves et al. | 215/330 |
| 4,699,285 | 10/1987 | Perne et al. | 215/329 X |

FOREIGN PATENT DOCUMENTS

| | | | |
|---|---|---|---|
| 963845 | 3/1975 | Canada | 215/330 |
| 2421006 | 11/1975 | Fed. Rep. of Germany | 215/329 |
| 646323 | 9/1962 | Italy | 215/330 |

*Primary Examiner*—Stephen Marcus

*Attorney, Agent, or Firm*—Harpman & Harpman

[57] ABSTRACT

A closure and container having pass over inter-engaging teeth of novel configurations enable the closure to be threadably engaged on the neck finish of the container with relatively low torque rotation and removed from the container only with relatively greater torque rotation in the opposite direction.

5 Claims, 1 Drawing Sheet

CLOSURE AND CONTAINER HAVING PASS OVER INTER-ENGAGING RATCHET TEETH

BACKGROUND OF THE INVENTION

1. Technical Field

This invention relates to containers and closures therefor of the so-called child-resistant type.

2. Description of the Prior Art

Prior devices of this type usually employ some sort of inter-engaging means on the portion of the closure engaging the neck finish of the container. A container-closure assembly with detent means for positively positioning the closure with respect to the container may be seen in U.S. Pat. No. 4,289,248 wherein threading of the closure of the neck of the container causes an inwardly extending projection of the closure to contact downwardly extending projections on the neck of the container necessitating a slightly greater rotational force to be torsionally applied to cause the projections of the closure to override the projections on the neck on the container.

U.S. Pat. No. 4,387,822 shows a similar construction and a further variation of the same may be seen in U.S. Pat. No. 4,770,308.

U.S. Pat. No. 4,461,394 discloses a closure and a container combination in which circumferentially positioned thread-like configurations are formed of a plurality of alternate ridges and indentations so arranged for registry with one another that the closure can be applied to or removed from the container simply by applying laternal pressure in an appropriate direction.

U.S. Pat. No. 4,697,715 discloses a closure and container combination wherein the configuration of inter-engaging threads on the neck and in the closure permit applying the closure with a low torque rotation while requiring a relatively high torque removal rotation.

Finally, U.S. Pat. No. 4,799,597 discloses interlocking groups of ratchet teeth shaped and arranged to permit the closure to be rotatably positioned on the container, but prevent its removal without damage to the closure.

This invention eliminates the complex difficult fo form fastening configurations of the prior art and provides an easier, quicker, more practical means of applying a child-resistant type closure to a container and removing the same therefrom.

SUMMARY OF THE INVENTION

A closure and container having passover inter-engaging ratchet teeth forms a group of outwardly projecting modified ratchet teeth on side of the neck finish of a container and groups of oppositely diposed inwardly projecting modified ratchet teeth on the inner surface of the closure. The modified ratchet teeth on the neck finish of the container having substantially flat outermost surfaces and each of the modified ratchet teeth is formed with oppositely inclined surfaces with the inclines being of different degrees with respect to a center line extending from the center of the neck of the container radially through the center of each of the modified ratchet teeth.

Each of the two groups of modified ratchet teeth on the inner surface of the closure form an arcuate configuration including a plurality of cavities for registering reception of the modified ratchet teeth of the group of outwardly projecting modified ratchet teeth on the neck of the container. Each group of modified ratchet teeth on the inner surface of the closure extend about one-fourth of the circumference of said closure. Clockwise rotation of the closure when it is applied to the neck of the container will accordingly present the 60° angled surfaces of the group of outwardly projecting modified ratchet teeth on the container neck to each of the registering 60° angled surfaces of the modified ratchet teeth of the two groups thereof defining the plurality of cavities on the inside of the closure so as to require relatively low torque or rotating effort to apply the closure to the container. Conversely, each of the teeth of the two groups of modified ratchet teeth on the inside of the closure and defining the plurality of caivities that register with the group of outwardly projecting modified ratchet teeth on the exterior of the neck of the container requires considerably more torque or rotating force when the closure is moved counterclockwise as necessary to remove the same from the neck of the container because of the engagement of the 45° angled surfaces of the engaging groups of modified ratchet teeth. The resiliency of the material of the closure and to some extent the resiliency of the material of the neck of the container, enable the inter-engaging 60° surfaces of the engaging groups of modified ratchet teeth to easily pass over one another when the closure is revolved clockwise and to require considerably more torque or rotating effort when the closure is revolved counter-clockwise as necessary to remove the same from the neck of the container.

DESCRIPTION OF THE PREFERRED EMBODIMENT

In the form of the invention disclosed herein, the invention comprises a closure having a top portion 10 with a depending annular flange 11 on its peripheral edge. A section 12 of a slightly greater dimension than the depending annular flange 11 forms the lower edge thereof and thickened upwardly extending triangular reinforcing configurations 13 are positioned about the flange 11 in circumferentially spaced relation so as to reinforce the depending annular flange 11 and at the same time permit its deformability which occurs each time the closure is turned onto the neck configuration of a container or removed therefrom as hereinafter described.

Figure 1:
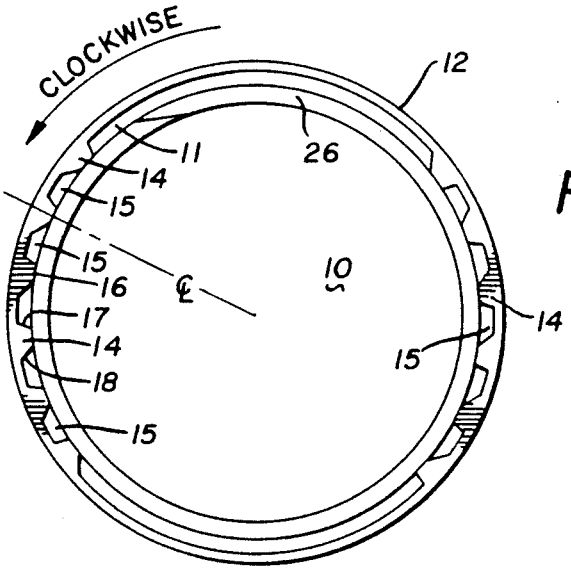
FIG. 1 is a bottom plan view of the closure of the combination.
Figure 2:
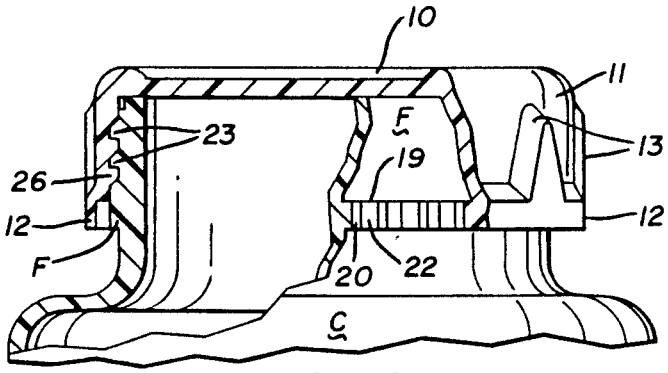
FIG. 2 is a side elevation of the closure and container with parts broken away and parts in cross section.

By referring to FIGS. 1 and 2 of the drawings, it will be seen that two groups of modified ratchet teeth 14 are formed on the inner surface of the section 12 in oppositely disposed relation to one another so that each group defines several circumferentially spaced cavities 15, the opposite sides of the cavities being inclined and the angles of inclination being different.

Referring specifically to FIG. 1 of the drawings, it will be seen that each of the teeth 14 has an innermost substantially flat surface 16, a first angled surface 17 and a second angled surface 18, the angled surface 17 being at approximately 45° from a radical center line extending through the tooth 16 from the center of the closure and the opposite angle of the second angled 18 being at substantially 60° from the same center line.

The teeth 14 space the cavities 15 and accordingly form the bottom and side walls of each of the cavities 15. The neck finsih F of the container C is best illustrated in FIGS. 3 and 4 of the drawings and by referring thereto it will be seen that the group of outwardly projecting modified ratchet teeth 19 are positioned in spaced relation to one another on the neck finish F of the container C and that each of the teeth 19 has a substantially flat outermost surface 20 with its opposite sides defining inclined surfaces 21 and 22 respectively.

Figure 3:
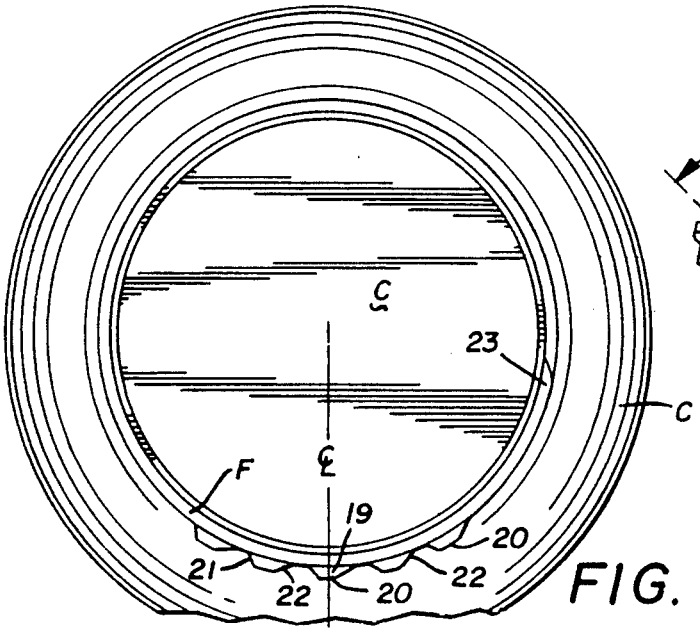
FIG. 3 is a top plan view of the neck of the container.
Figure 4:
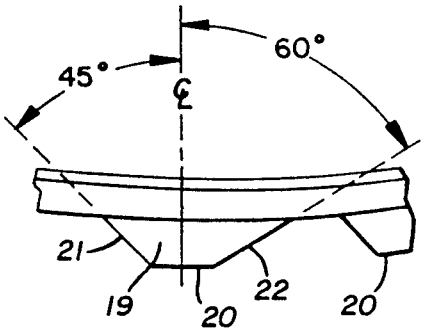
FIG. 4 is an enlarged fragmentary top plan view of a portion of the neck of the container and one of the outwardly projecting modified ratchet teeth thereon.

In FIG. 3 of the drawings, a center line shown extending from the center of the container C radially through one of the teeth 19 and by referring to FIG. 4 and enlarged detail of one of the teeth 19 of FIG. 3 may be seen together with the center line therethrough. The oppositely inclined surfaces 21 and 22 of the tooth 19 are also illustrated and broken lines extend their angular planes to a point inwardly of the neck finish F where the 45° and 60° indicia extend from the broken lines to the center line. The inclined surface 22 of each of the modified ratchet teeth 19 of the neck finish of the container is positioned so that the similar matching inclined surface 18 of the teeth 14 on the inner surface of the portion 12 of the closure will easily pass over one another when the closure is rotated as in applying it to the neck finish of the container. The neck finish F of the container is provided with a continuous spiral thread 23 as best shown in FIG. 2 of the drawings wherein the upper surface of the continuous spiral thread 23 is preferably formed at an outward and downward angle of approximately 45° from horizontal as indicated at 24 in FIG. 2 of the drawings and its lower surface is preferably formed at an angle of 10° from horizontal as indicated at 25 in FIG. 2 of the drawings. A continuous thread 26 in the closure engages the tread 23.

It will occur to those skilled in the art that a single group of the modified ratchet teeth 14 may be used in the closure rather than two groups hereinbefore described and the single group elongated so as to provide an increased number of cavities 15 for registry with at least some of the teeth 19 of the group of teeth 19 on the neck finish F of the container. When such change is made in the closure an additional group of teeth 19 may be used on the neck finish F of the container, the additional group being oppositely disposed with respect to the other. It will occur to those skilled in the art that by reason of the novel configuration of the groups of modified ratchet teeth 14 and the cavities 15 defined thereby on the inner surface of the portion 12 of the closure and the group of outturned projecting modified ratchet teeth 19 on the outside of the neck finish F of the container C, the combination works particularly well and enables the closure to be turned onto the container in a clock-wise rotation with a predetermined torque rotation effort while removing the closure from the container neck finish necessitates a considerably greater torque rotation force which renders the closure and container child-resistant and thereby meets the primary object of the invention as well as providing structures which are relatively easily molded and therefore economically produced.

Although but one embodiment of the present invention has been illustrated and described, it will be apparent to those skilled in the art that various changes and modifications may be made therein without departing from the spirit of the invention and having thus described my invention, what I claim is:

1. A closure and container assembly having pass over inter-engaging means comprising a container having a neck finish with a centerline; a closure threadably received on said neck finish; and closure including a top portion, a depending annular flange on said top portion; a section of said depending annular flange forming a lower edge thereof being of a slightly greater dimension than the depending annular flange, two spaced apart groups of modified ratchet teeth in said section of said depending annular flange, each group of modified ratchet teeth including a plurality of individual modified ratchet teeth, each tooth of said modifed teeth of said two groups of modified ratchet teeth in said section of said depending annular flange being spaced apart from adjacent teeth and defining a cavity with each of such adjacent teeth to define a plurality of cavities, each of the modified ratchet teeth of said two groups of modifed ratchet teeth in said section of said depending annular flange having a substantially flat innermost surface which is spaced from said depending annular flange and two inclined side surfaces which intersect said innermost surface and said annular flange to form roots, said innermost surface all lying on a common arc which is centered at the center of the cap, each of said side surfaces being inclined with respect to a radially positioned center line extending through each of said modified rachet teeth of said two groups in said section of said depending annular flange, each of said side surfaces also being inclined oppositely to the other side surface of said each tooth to diverge away from each other and from said innermost surface and defining opposite sides of said cavities, said oppositely inclined side surfaces of each tooth of said modified ratchet teeth of each of said groups in said section of said depending annular flange having different annular inclines with one of the oppoositely inclined side surfaces being longer than the other, another group of modified ratchet teeth being formed on said neck finish of said container, the modified ratchet teeth on said neck finish of said container being shaped and positioned for engagement and registry in said cavities defined by said modified ratchet teeth in said section of said depending annular flange, each of said modified ratchet teeth of said another group of said modified ratchet teeth on said neck finish of said container having oppositely inclined side surfaces matching said oppositely inclined side surfaces of said modified ratchet teeth of said two groups of modified ratchet teeth in said section of said depending annular flange, said oppositely inclined side surface of each of the modified ratchet teeth of said another group of modified ratchet teeth on said neck finish of said container having different angular inclines with respect to said radially positioned centerline, one of the oppositely inclined side surfaces of each tooth of said another group being longer than the other side surface of said each tooth of said another group so that the longer inclined side surfaces of each of the modified ratchet teeth of each of said groups of modified ratchet teeth in said section of said depending annular flange engage the longer inclined side surfaces of each of said modified ratchet teeth of said another group of modified ratchet teeth on said neck finish of said container when said closure is resolved clockwise on said neck finish of said container, each tooth of said another group having a substantially flat outermost surface, with all of said outermost surfaces lying on a common arc centered at the neck finish centerline, said side surfaces of each tooth in said another group of teeth intersecting said neck finish to form roots with each of said teeth in said another group being spaced from adjacent teeth in said another group of teeth to define a plurality of neck finish cavities, the side surfaces of each tooth in said another group of teeth-diverging away from each other and from the outermost surface of that each tooth.

2. The closure and container assembly of claim 1 and wherein said different angular inclines are respectively 45° and 60° from a radially positioned center line extending through each of said modified teeth.

3. The closure and container assembly of claim 1 and wherein said different angular inclines are respectively 45° and 60° from a radially positioned center line extending through each of said modified teeth and wherein the 60° inclined side surfaces of each of the modified teeth defines the leading edge of each of said teeth when said closure is revolved clockwise.

4. The closure and container assembly of claim 1 and wherein each of said two groups of said modified ratchet teeth in said section of said depending annular flange extends for only one-fourth of the circumference of said section of said depending annular flange.

5. The closure and container assembly of claim 1 wherein said two groups of said modified ratchet teeth in said section of said depending annular flange of said closure define two groups of said plurality of cavities.

* * * * *